US008596452B1

(12) United States Patent
Banks

(10) Patent No.: US 8,596,452 B1
(45) Date of Patent: Dec. 3, 2013

(54) UNDERGARMENT TRAVEL CASE

(76) Inventor: Nora Banks, Jupiter, FL (US)

( * ) Notice: Subject to any disclaimer, the term of this patent is extended or adjusted under 35 U.S.C. 154(b) by 2 days.

(21) Appl. No.: 13/106,564

(22) Filed: May 12, 2011

(51) Int. Cl.
*H05B 6/80* (2006.01)
*A42C 1/00* (2006.01)

(52) U.S. Cl.
USPC ..... 206/292; 206/278; 223/84

(58) Field of Classification Search
USPC ..... 206/292, 278, 515, 469, 45.34, 45.32; 223/84; 220/501, 532, 529
See application file for complete search history.

(56) References Cited

U.S. PATENT DOCUMENTS

| | | | | |
|---|---|---|---|---|
| D152,653 | S * | 2/1949 | Rinehart | D3/284 |
| 3,190,435 | A | 6/1965 | Schlanger | |
| 3,837,476 | A | 9/1974 | Schwartz | |
| 5,556,013 | A | 9/1996 | Mayer | |
| 5,829,083 | A | 11/1998 | Sutton | |
| 5,971,236 | A * | 10/1999 | DesForges et al. | 223/84 |
| 6,061,840 | A * | 5/2000 | Alligator | 2/403 |
| 6,742,683 | B1 | 6/2004 | Phan | |
| 6,761,291 | B2 | 7/2004 | Moskovitz et al. | |
| 7,163,605 | B2 | 1/2007 | Chen | |
| 7,252,573 | B2 | 8/2007 | Mann | |
| 7,350,679 | B2 * | 4/2008 | Radtke et al. | 223/84 |
| D569,618 | S * | 5/2008 | Kirk | D3/291 |
| 7,516,840 | B2 | 4/2009 | Troha et al. | |
| 7,647,795 | B2 * | 1/2010 | Kitaya | 68/235 R |
| 7,922,046 | B2 * | 4/2011 | Radtke et al. | 223/84 |
| 2008/0289978 | A1 * | 11/2008 | Malick | 206/278 |
| 2010/0011817 | A1 * | 1/2010 | Yoon | 68/235 R |
| 2010/0219213 | A1 * | 9/2010 | Phan | 223/84 |

* cited by examiner

*Primary Examiner* — J. Gregory Pickett
*Assistant Examiner* — Ernesto Grano
(74) *Attorney, Agent, or Firm* — Gold & Rizvi, P.A.; Glenn E. Gold

(57) ABSTRACT

A system and method for storing a cupped brassiere and panty in an undergarment travel case is provided. The travel case has a lid and bowl shaped container that are connected to each other by a living hinge. The bowl shaped container has a recess that is formed in a generally flat bottom of the container. The recess receives underwire portions of the cupped brassiere. The brassiere is folded such that the cups face each other in a mirror image arrangement with the underwire portions being positioned against one another. Upon insertion, downward pressure is applied to the underwire portions of the brassiere. This pressure locates and positions the brassiere in the recess of the travel case. Next, a set of brassiere support straps connected to the brassiere are then folded and placed within a central interior portion of the cups. The panty is then folded and placed next to the support straps. The cover is then closed and the case is latched together through latching components. As such, the travel case of the present invention provides for a neat, secure and compact system and method for transporting and storing undergarments.

15 Claims, 6 Drawing Sheets

UNDERGARMENT TRAVEL CASE

FIELD OF THE INVENTION

The present disclosure generally relates to a travel container and lid for storing undergarments such as a cupped brassiere and panty. More particularly, the present disclosure relates to a bowl shaped container and lid that includes a recess for receiving an underwire portion of the brassiere cups with the panty being folded within.

BACKGROUND OF THE INVENTION

The present invention provides an undergarment storage and travel case for a brassiere and panty that prevents the undergarments from being malformed, compressed or distorted during travel.

It is not uncommon for a brassiere and panty to become distorted during storage and travel when they are exposed to external pressures in a suitcase or travel bag. These external pressures can crush and deform the brassiere and wrinkle the panty. As such, when the undergarments are worn under a fine dress or blouse, the deformation and wrinkles can show through. These imperfections are unattractive and they place the wearer in an uncomfortable position.

What is desired is an undergarment travel case that secures a brassiere and panty neatly, safely and compactly for travel and storage. The present invention accomplishes this goal because it provides a lid and bowl shaped container that conforms with the shape of the cups of the brassiere. The bowl locates and secures underwire portions of the brassiere in an underwire recess to secure the position of the brassiere. This prevents it from becoming distorted. The bowl and lid combination further protects the undergarments from being crushed in a suit case or travel bag.

SUMMARY OF THE INVENTION

The basic inventive concept provides an undergarment travel case for storing a brassiere and panty during travel.

A first aspect of the present invention provides an undergarment travel case for storing a cupped brassiere and panty, comprising:

a bowl shaped container having a generally flat bottom, a top rim, and a bowl shaped outer surface;

an underwire receiving recess disposed along the generally flat bottom and partially along an inner surface of the bowl shaped container; and a lid having an outer perimeter and a generally round flat top and a circular band that transverses the outer perimeter, the lid for enclosing the bowl shaped container.

In a second aspect, the undergarment travel case includes a first step that transverses a perimeter of an inner lip of the lid and a second step that transverses a perimeter of an outer edge of the top rim of the bowl shaped container. Wherein, when the lid is closed over the bowl shaped container the first step and second step of the top rim are configured to interlock with one another about their respective perimeters.

In another aspect, the undergarment travel case provides the brassiere being configured by placing each of the brassiere cups facing each other in a mirror image arrangement with support underwire portions being positioned against one another.

In another aspect, the undergarment travel case further provides the underwire portions of the cupped brassiere being received into the underwire receiving recess. Wherein, the underwire receiving recess positions and secures the cups of the brassiere into the bowl shaped container.

In yet another aspect, the undergarment travel case also provides the panty being folded and placed within a central interior portion of the cups of the brassiere.

In yet another aspect, the undergarment travel case has a living hinge that connects an outer edge of a lip of the lid to an outer edge of the top rim of the bowl shaped container. The living hinge allows the lid to pivot about the bowl shaped container.

In yet another aspect, the undergarment travel case includes a latching assembly that is disposed on the lid and bowl shaped container. The latching assembly is provided along with the living hinge to positively secure and latch the lid to the bowl shaped container.

In yet another aspect, the undergarment travel case further includes a flap that extends from the lip of the lid, a first projection that is disposed on the flap and a protrusion that is disposed on the first projection. The undergarment travel case also includes a second projection that is disposed on an outer upper edge of the bowl shaped container and a recess that is formed inside the second protrusion. Wherein, when the lid is pivoted and closed over the bowl shaped container the protrusion snaps into the recess formed in the second projection and latches the lid and bowl together.

In yet another aspect, the undergarment travel case provides a hook and loop arrangement. Wherein, one of the hook and loop is disposed on one of the lid and bowl shaped container. Wherein, when the lid is closed over the bowl the loop is directed to catch the hook to secure the lid and bowl shaped container together.

In yet another aspect, the undergarment travel case further provides at least two ribbons. One ribbon being disposed on the lid and one ribbon being disposed on the bowl shaped container. Wherein, when the lid is closed over the bowl the ribbons are tied together to secure the lid to the bowl shaped container.

In yet another aspect, the undergarment travel case also provides a frog closure arrangement that has a loop and frog portion. Wherein, one of the loop and frog portion is disposed on one of the lid and bowl shaped container. Wherein, when the lid is closed over the bowl, the frog portion is inserted within the loop to secure the lid to the bowl shaped container.

In yet another aspect, an undergarment travel case is provided for storing a cupped brassiere and panty, comprising:

a bowl shaped container having an underwire receiving recess disposed along a generally flat bottom;

a lid, the lid for enclosing the bowl shaped container; and wherein, the receiving recess receives an underwire portion of the cups of the brassiere.

In yet another aspect, the undergarment travel case includes the panty being folded and placed within an interior portion of the cups of the brassiere.

In yet another aspect, a method of storing a cupped brassiere and panty in an undergarment travel case is provided. The bowl shaped container has an underwire receiving recess that is formed in a generally flat bottom and partially along an inner surface of the bowl shaped container. The container also has a lid having a generally round flat top and a circular band that transverses an outer perimeter of the flat top. The method comprises the steps of:

providing a cupped brassiere, the cupped brassiere having an underwire portion;

placing each of the brassiere cups facing each other in a mirror image arrangement with underwire portions being positioned against one another; and receiving the underwire portions of the cups into the underwire receiving recess.

In yet another aspect, the method further comprises the step of securing the underwire portions of the brassiere cups into the underwire receiving recess by applying downward pressure to the underwire portions of the cups.

In yet another aspect, the method also provides the steps of folding the panty together and placing the panty within a central interior portion of the cups of the brassiere.

In yet another aspect, the method further provides the steps of providing a set of brassiere straps connected to the cups and folding the set of brassiere straps into a central interior portion of the cups of the brassiere.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
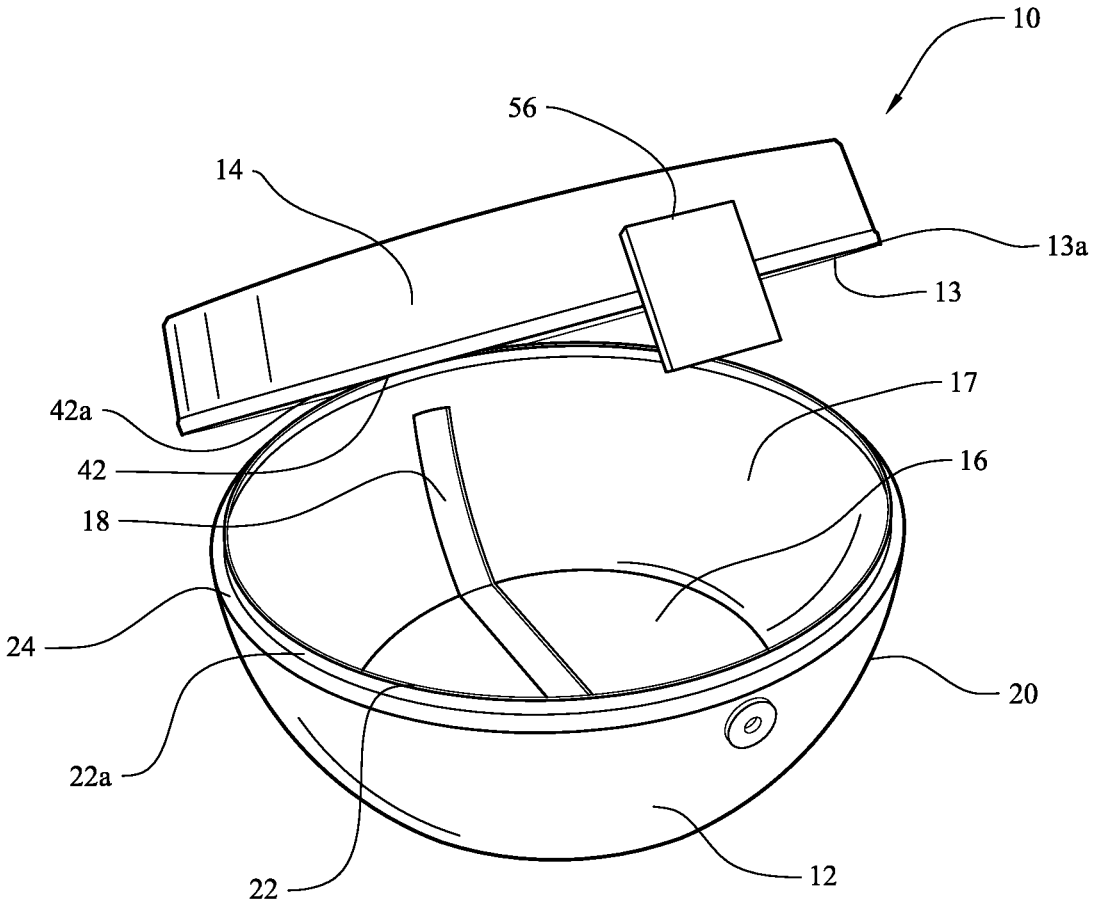
FIG. 1 presents a detailed isometric view of an exemplary cupped brassiere and panty travel container in accordance with one embodiment of the invention, illustrating a bowl shaped container and lid in an opened position.

There is shown in FIG. 1 an undergarment travel case 10 for storing underclothes in a neat and compact fashion. Undergarment travel case 10 provides a bowl shaped container 20 that has a generally flat bottom 16, a top rim 22, and a bowl shaped outer surface 12. The generally flat bottom 16 includes an underwire receiving recess 18 that is disposed along the generally flat bottom 16. The underwire receiving recess also extends partially up along an inner surface 17 of the bowl shaped container 12. As illustrated in FIG. 1, the underwire receiving recess 18 forms a longitudinally extending groove defining a long narrow generally rectangular indentation centrally disposed along the inner surface of the bowl shaped container 20. The undergarment travel case 10 further provides a lid 14 that has an outer perimeter and a generally round flat top 54. The lid 14 includes a circular band 55 that transverses the outer perimeter. The lid 14 being used to enclose the bowl shaped container 20.

Undergarment travel case 10 further provides a living hinge 42 that connects an outer edge 13*a* of a lip 13 of the lid 14 to an outer edge 22*a* of the top rim 22 of the bowl shaped container 20. The living hinge 42 allows the lid 14 to pivot about the bowl shaped container 20 along a hinge line 42*a* to open and close the travel case. A living hinge is a thin flexible hinge made from plastic that joins two rigid plastic parts together, allowing them to bend along the line of the hinge.

Living hinges are typically manufactured in an injection molding operation that creates a single part, and if correctly designed and constructed, the hinge can remain functional over the life of the part. Polyethylene and polypropylene are considered to be the best resins for living hinges, due to their excellent fatigue resistance. These joints can typically flex more than a million cycles without failure.

Figure 5:
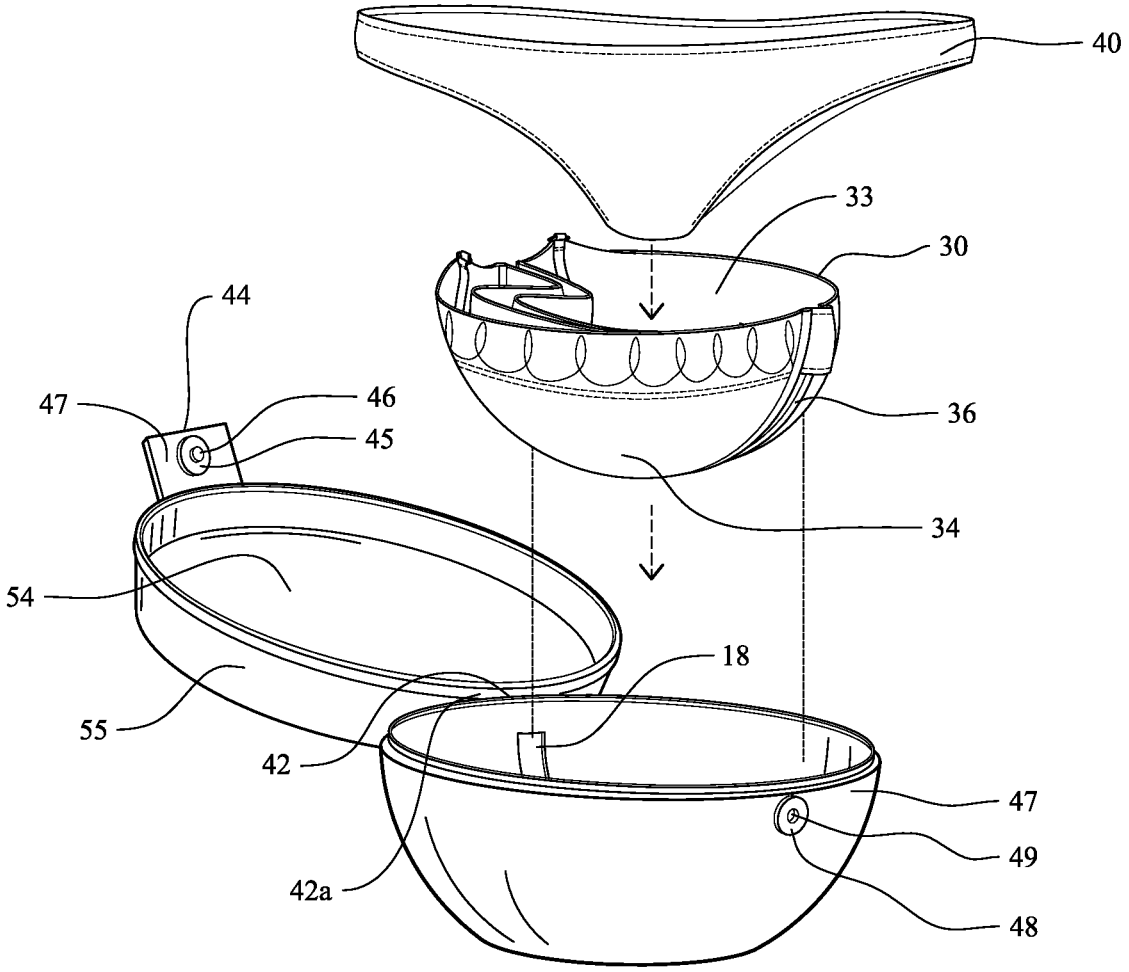
FIG. 5 presents a detailed isometric view of the assembly of the cupped brassiere and panty being placed into the travel case for storage and transport.

Now referring to FIGS. 1 and 5, undergarment travel case 10 also provides latching components that are disposed on the lid 14 and bowl 12. The lid includes a flap 44 that extends roughly from a midway section 56 of the circular band 55 down past the lip 13 of the lid 14. The flap 44 is generally rectangular in shape and is thinner in material thickness than the lid 14 itself. This is because it needs to be flexible, as will be henceforth explained. The lid also includes a first projection or button 45 that is disposed on an inner surface 47 of the flap 44. The button 45 has a first protrusion 46 that is disposed on its center. The protrusion 46 is typically in the shape of a half sphere. However, it should be noted that the protrusion should not be limited to a half sphere and could be configured to have any other geometric or alphanumeric profile.

The bowl shaped container 20 includes a second projection 48 that is disposed on an outer upper edge 47 of the bowl shaped container 20. An annular recess 49 is formed inside the center of the second protrusion 48. The annular recess 49 is designed to receive the protrusion 46 disposed on button 45. Consequently, when the lid 14 is pivoted and closed over the bowl shaped container 20 the first protrusion 46 snaps into the annular recess formed in the second projection 48 and latches the lid and bowl together. In combination, the living hinge and latching components secure the lid to the bowl. The first protrusion and annular recess interlock under physical pressure to prevent the lid from opening prematurely. To open the lid from a closed position, outward pressure need be applied to the flap of the lid to disengage the first protrusion from the annular recess. Then, the lid can be lifted up and away from the bowl while being supported by the living hinge.

Figure 6:
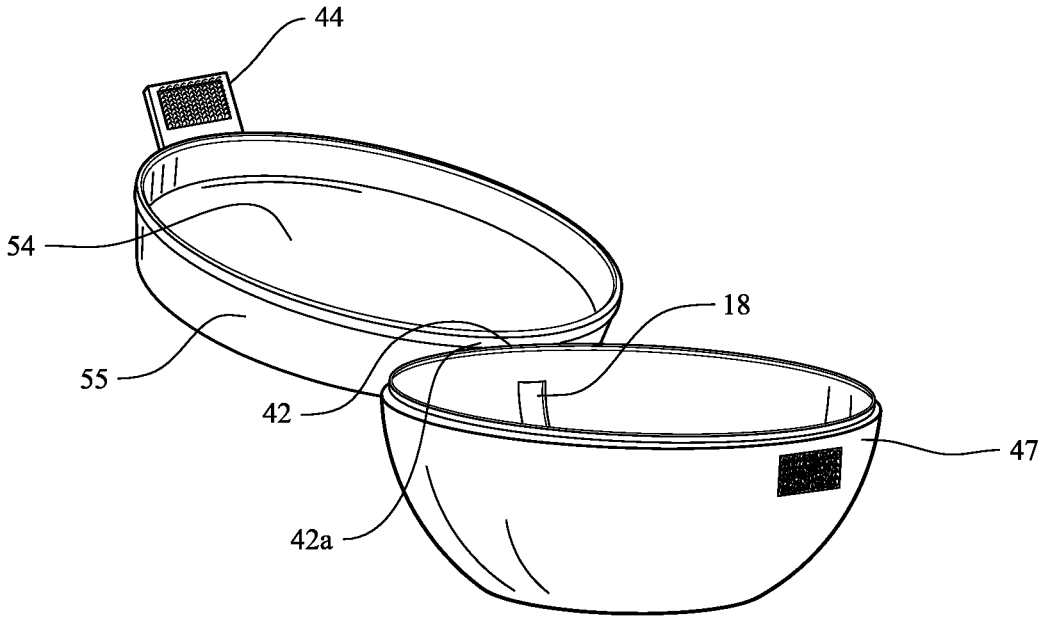
FIG. 6 presents a detailed perspective view of an alternative embodiment of the travel case, having a hook and loop fastener.

In an alternate embodiment of the present invention (illustrated in FIG. 6), the latching components could provide a hook and loop arrangement. One of the hook and loop is disposed on one of the lid and bowl shaped container. Here, when the lid is closed over the bowl the loop is designed and directed to catch the hook. As such, the hook and loop arrangement secures the lid and bowl together.

Figure 7:
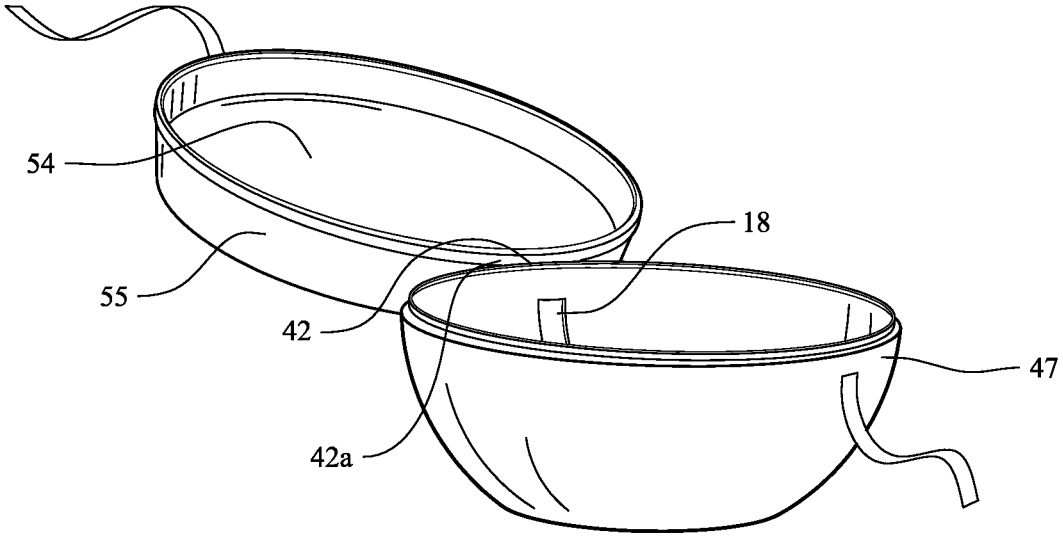
FIG. 7 presents a detailed perspective view of an alternative embodiment of the travel case, having a ribbon fastener.

In an alternate embodiment of the present invention (illustrated in FIG. 7), the latching components could provide at least two ribbons. Here, one ribbon is disposed and attached to the lid on an end opposite of the living hinge and one ribbon is disposed and attached to the bowl on an end opposite of the living hinge. When the lid is closed over the bowl, the ribbons can be tied together to secure the lid to the bowl shaped container together.

Figure 8:
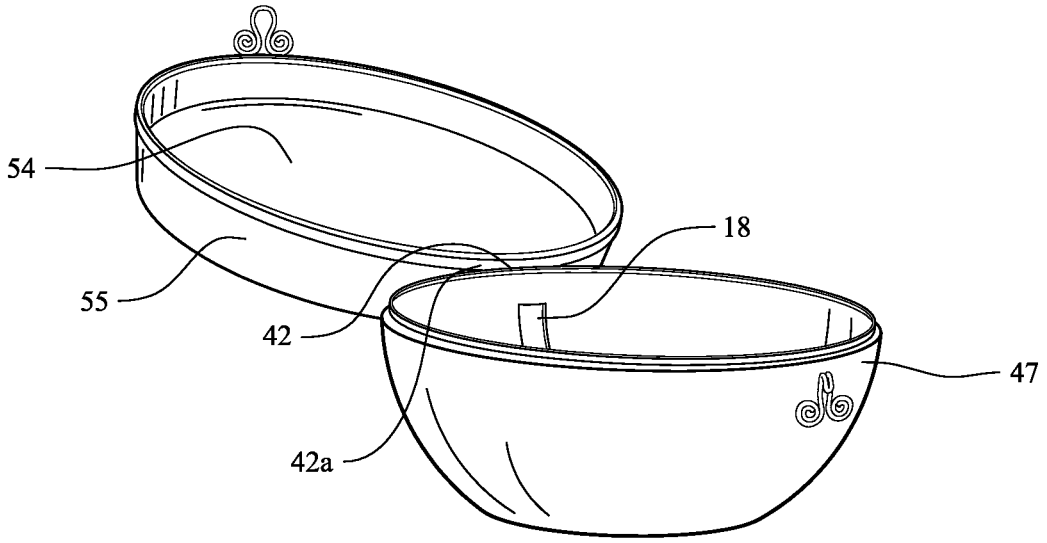
FIG. 8 presents a detailed perspective view of an alternative embodiment of the travel case, having a loop and frog fastener.

In an alternate embodiment of the present invention (illustrated in FIG. 8), the latching components could provide a frog closure arrangement that includes a loop and frog portion. One of the loop and frog portion is disposed on one of the lid and bowl shaped container. When the lid is closed over the bowl the frog portion is manually inserted into the loop. As such, the frog and loop arrangement secures the lid and bowl together.

Figure 2:
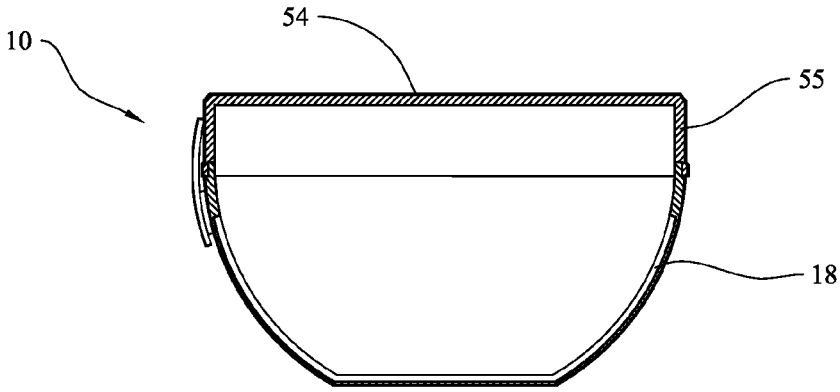
FIG. 2 presents a cross sectional view of the exemplary travel case originally introduced in FIG. 1, the illustration presenting the interaction between the material layers of the lid and bowl.
Figure 3:
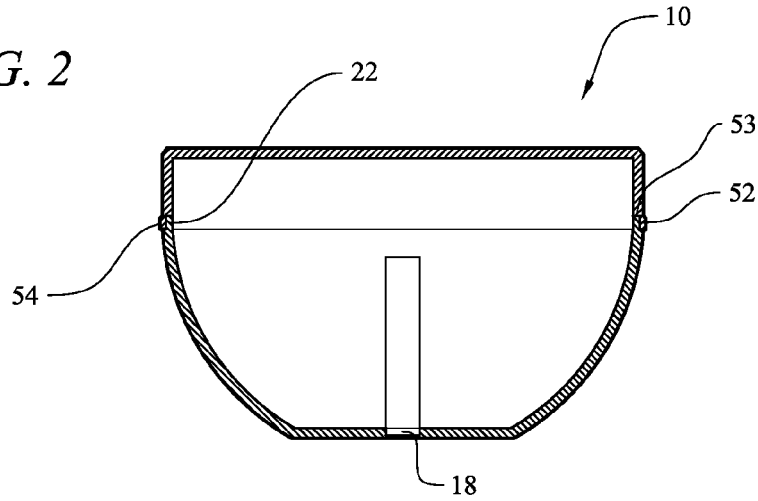
FIG. 3 presents a further cross sectional view of the exemplary travel case detailing an underwire receiving recess.

Now referring to FIGS. 2 and 3, there are shown cross-sectional views of the undergarment travel case assembly 10 taken on a plane traversing through the center of the underwire receiving recess 18 and perpendicular to the center of the underwire receiving recess 18 respectively. The lid 14 further provides a first step 52 that transverses a perimeter of an inner lip 53 of the lid and a second step 54 that transverses a perimeter of an outer edge 24 of the top rim 22 of the bowl shaped container 20. Consequently, when the lid is closed over the bowl shaped container the first step in the inner lip and second step in the top rim are configured to interlock with one another about their respective perimeters.

Figure 4:
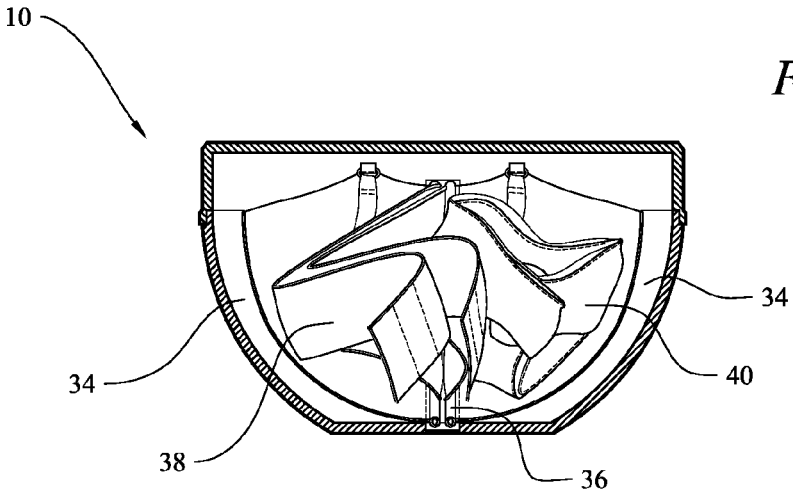
FIG. 4 presents a further cross sectional view of the exemplary travel case illustrating the brassiere and panty folded and stored within the cups of the brassiere.

Now referring to FIGS. 4 and 5, a method of storing a cupped brassiere 30 and panty 40 in the undergarment travel case 10 will now be disclosed. For purposes of this disclosure it will be assumed that the lid of the travel case is already in the open position. As previously disclosed the bowl shaped container includes underwire receiving recess 18 that is formed in the generally flat bottom 16 and partially along an inner surface 17 of the bowl shaped container. The cupped 34 brassiere 30 having underwire portions 36 and a set of support straps 38 are first provided. A user then folds each of the brassiere cups 34 so that they face each other in a mirror image arrangement. As such, the underwire portions 36 are positioned against one another. The user then folds the set of support straps 38 into a central interior portion 33 of the cups 34 and underwire portions 36.

A downward pressure is then applied to the underwire receiving portions. The downward pressure directs the underwire receiving portions into the underwire receiving recess. Consequently, the underwire portions are received into the underwire receiving recess and are secured in place. The panty 40 is then folded together by the user. It is then placed within the central interior portion 33 of the cups 34 of the brassiere 30 next to the set of brassiere straps 38. When the lid is closed a slight pressure is generated between the contact of the lid and the panty and brassiere. The gentle contact is enough to keep the underwire portions of the brassiere held within the underwire recess. This unique arrangement provides for the storage of a bra and panty in a neat, secure and compact fashion.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. An undergarment travel case for storing a cupped brassiere and panty, comprising:

a bowl shaped container formed as a shell having a spherical segment shape, wherein the spherical segment shape comprises a generally planar base and a spherical zone being contiguous about and extending upward from a peripheral edge of the generally planar base and terminating at a shell upper edge, wherein a concave portion of the spherical zone and respective portion of the generally planar base define an interior surface of the bowl shaped container and a convex portion of the spherical zone and respective portion of the generally planar base define an exterior surface of the bowl shaped container;

an underwire receiving recess comprising:

a base receiving recess section extending inward from the generally planar base interior surface and centrally traversing the generally planar base interior surface, and a pair of wall underwire receiving recess sections, each wall underwire receiving recess section being contiguous with the base receiving recess section, extending upward from a respective end of the underwire receiving recess and continuing generally longitudinally along the spherical zone interior surface, terminating at a distance from the shell upper edge, wherein each of the pair of wall underwire receiving recess sections are located approximately 180 degrees from one another; and a lid having an outer perimeter and a generally round flat top and a circular band that is oriented transverse to the outer perimeter, the lid for enclosing the bowl shaped container.

2. An undergarment travel case as recited in claim 1, wherein the cupped brassiere is configured orienting each of the brassiere cups facing each other in a mirror image arrangement with support underwire portions being positioned against one another.

3. An undergarment travel case as recited in claim 2, further comprising the cupped brassiere, wherein the underwire portions of the cupped brassiere are seated into the underwire receiving recess; and the underwire receiving recess positions and secures the cups of the brassiere within the bowl shaped container.

4. An undergarment travel case as recited in claim 3, further comprising the panty, wherein the panty is folded and placed within a central interior portion formed between the cups of the brassiere.

5. An undergarment travel case as recited in claim 1, further comprising a living hinge that connects an outer edge of a lip of the lid to an outer edge of the top rim of the bowl shaped container, wherein the living hinge allows the lid to pivot about the bowl shaped container.

6. An undergarment travel case as recited in claim 5, further comprising a latching assembly disposed on the lid and bowl shaped container, the latching assembly provided in combination with the living hinge to positively secure and latch the lid to the bowl shaped container.

7. An undergarment travel case as recited in claim 6, further comprising;

a flap that extends from the lip of the lid;

a first projection disposed on the flap;

a protrusion disposed on the first projection;

a second projection disposed on an outer upper edge of the bowl shaped container;

a recess formed inside the second protrusion; and wherein, when the lid is pivoted and closed over the bowl shaped container the protrusion snaps into the recess formed in the second projection and latches the lid and bowl together.

8. An undergarment travel case as recited in claim 6, further comprising a dense hook and loop arrangement comprising a hook bed section and a mating loop pile section; and wherein, one of the hook bed section and loop pile section is disposed on one of the lid and bowl shaped container, and wherein, when the lid is closed over the bowl the loop pile section is directed to catch the hook bed section to secure the lid and bowl shaped container together.

9. An undergarment travel case as recited in claim 6, further comprising a first ribbon disposed on the lid and a second ribbon disposed on the bowl shaped container;

wherein, when the lid is closed over the bowl, the first ribbon and the second ribbon are tied together to secure the lid to the bowl shaped container.

10. An undergarment travel case as recited in claim 6, further comprising a frog closure arrangement having a loop and frog portion, wherein, one of the loop and frog portion is carried by one of the lid and the other of the loop and frog portion is carried by the bowl shaped container, when the lid is closed over the bowl shaped container the frog portion is inserted within the loop to secure the lid to the bowl shaped container.

11. An undergarment travel case as recited in claim 1, further comprising a first step that transverses a perimeter of an inner lip of the lid and a second step that transverses a perimeter of an outer edge of the top rim of the bowl shaped container, wherein, when the lid is closed over the bowl shaped container the first step and the second step of the top rim are configured to interlock with one another about their respective perimeters.

12. A method of storing a cupped brassiere and panty in an undergarment travel case, said method comprising the steps of:

obtaining an undergarment travel case for storing a cupped brassiere and panty, the undergarment travel case comprising:

a bowl shaped container formed as a shell having a spherical segment shape, wherein the spherical segment shape comprises a generally planar base and a spherical zone being contiguous about and extending upward from a peripheral edge of the generally planar base and terminating at a shell upper edge, wherein a concave portion of the spherical zone and respective portion of the generally planar base define an interior surface of the bowl shaped container and a convex portion of the spherical zone and respective portion of the generally planar base define an exterior surface of the bowl shaped container, a bowl shaped container formed as a shell having a spherical segment shape, wherein the spherical segment shape comprises a generally planar base and a spherical zone being contiguous about and extending upward from a peripheral edge of the generally planar base and terminating at a shell upper edge, wherein a concave portion of the spherical zone and respective portion of the generally planar base define an interior surface of the bowl shaped container and a convex portion of the spherical zone and respective portion of the generally planar base define an exterior surface of the bowl shaped container;

an underwire receiving recess comprising:

a base receiving recess section extending inward from the generally planar base interior surface and centrally traversing the generally planar base interior surface, and a pair of wall underwire receiving recess sections, each wall underwire receiving recess section being contiguous with the base receiving recess section, extending upward from a respective end of the underwire receiving recess and continuing generally longitudinally along the spherical zone interior surface, terminating at a distance from the shell upper edge, wherein each of the pair of wall underwire receiving recess sections are located approximately 180 degrees from one another; and a lid having an outer perimeter and a generally round flat top and a circular band that is oriented transverse to the outer perimeter, the lid for enclosing the bowl shaped container;

obtaining a cupped brassiere, the cupped brassiere having an underwire portion;

orienting each of the brassiere cups facing each other in a mirror image arrangement with underwire portions being positioned against one another;

placing the arranged cupped brassiere into the cowl shaped container; and seating the underwire portions of the cups into the underwire receiving recess.

13. A method of storing a cupped brassiere and panty in an undergarment travel case as recited in claim 12, wherein the step of seating the underwire portions of the brassiere cups into the underwire receiving recess further comprises a step of applying a downward pressure to the underwire portion of the cups.

14. A method of storing a cupped brassiere and panty in an undergarment travel case as recited in claim 12, further comprising steps of;

obtaining a panty;

folding the panty together; and placing the panty within a central interior portion of the cups of the brassiere.

15. A method of storing a cupped brassiere and panty in an undergarment travel case as recited in claim 12, wherein the cupped brassiere further comprises a set of brassiere straps connected to the cups and the method further comprising a step of;

folding the set of brassiere straps into a central interior portion of the cups of the brassiere.

* * * * *